US005265421A

United States Patent [19]

Somers

[11] Patent Number: 5,265,421

[45] Date of Patent: Nov. 30, 1993

[54] UNDERWATER HYDRAULIC SYSTEM FOR REDUCING LIQUIDBORNE NOISE

[75] Inventor: George W. Somers, Severna Park, Md.

[73] Assignee: Westinghouse Electric Corp., Pittsburgh, Pa.

[21] Appl. No.: 916,352

[22] Filed: Jul. 20, 1992

[51] Int. Cl.[5] ..... F16D 31/02

[52] U.S. Cl. ..... 60/370; 60/419; 60/469; 91/4 A; 417/384

[58] Field of Search ..... 60/419, 421, 469, 416, 60/369, 370; 91/4 R, 4 A; 417/384

[56] References Cited

U.S. PATENT DOCUMENTS

| | | | |
|---|---|---|---|
| 3,065,703 | 11/1962 | Harman | 417/384 |
| 3,100,965 | 8/1963 | Blackburn | 91/4 R |
| 3,382,769 | 5/1968 | Raider | 91/448 |
| 4,741,673 | 5/1988 | Jubb | 417/394 |

*Primary Examiner*—Edward K. Look
*Assistant Examiner*—F. Daniel Lopez
*Attorney, Agent, or Firm*—D. Schron

[57] ABSTRACT

An hydraulic liquid system wherein a pump moves liquid from one location to another such as in supplying one or more loads in an underwater environment. The system includes two hydro-pneumatic chambers utilized such that one is filled by liquid from the pump while the other supplies the load, and as one hydro-pneumatic chamber empties, valves reconfigure the system such that the hydro-pneumatic chamber reverse roles. Each hydro-pneumatic chamber includes a liquid side and a gas side separated by a movable barrier with the gas sides of the hydro-pneumatic chambers being connected to one another thereby providing a large acoustic transmission drop across a liquid-gas boundary and subsequent gas-liquid boundary to interrupt the liquid noise path from the pump to the load.

13 Claims, 9 Drawing Sheets

UNDERWATER HYDRAULIC SYSTEM FOR REDUCING LIQUIDBORNE NOISE

BACKGROUND OF THE INVENTION

1. Field of the Invention

The invention in general relates to hydraulic liquid supplies, and more particularly, to an arrangement used in the underwater environment and wherein liquidborne noise is minimized.

2. Background Information

Liquidborne noise from hydraulic pumps is a major, and objectionable noise source in underwater systems such as submersible vehicles. In operation, hydraulic pumps excite the structure to which they are attached, they excite the surrounding medium and they excite the hydraulic liquid being pumped.

Structural excitation may be reduced by the use of isolation mountings and direct excitation of the surrounding ambient medium is reduced by the gas within the pressure vessel which provides a large acoustic transmission drop. Several techniques exist for reducing liquidborne noise including the use of an accumulator to smooth out hydraulic pulsations, as well as the use of mufflers and flexible hoses. None of these techniques, however, provide sufficient quieting, and noise generated within the hydraulic pump travels through the hydraulic lines such that it radiates to the surrounding ambient medium through the hydraulic tubing walls as well as a load (if utilized) being supplied with the hydraulic liquid.

The present invention provides for an improved arrangement for reducing liquidborne noise from the hydraulic pump.

SUMMARY OF THE INVENTION

An underwater hydraulic system for reducing fluidborne noise is provided and includes hydraulic pump means for delivering liquid from one location to another. In one embodiment the liquid is supplied to at least one hydraulic load. For such application, the system includes first and second hydro-pneumatic chambers each having a liquid side and a gas side separated by a movable barrier, with the gas sides of the hydro-pneumatic chambers being connected to one another. Valving means, operable in a first mode of operation, communicates the liquid provided by the pump means to the liquid side of the first hydro-pneumatic chamber while providing the liquid in the liquid side of the second hydro-pneumatic to the load as the gas is transferred from the first to the second hydro-pneumatic chamber. The valving means is operable in a second mode of operation to reverse the process whereby the liquid provided by the pump means is communicated to the liquid side of the second hydro-pneumatic chamber while the liquid in the liquid side of the first hydro-pneumatic chamber is provided to the load as the gas is transferred back from the second to the first hydro-pneumatic chamber.

Operation of the valving means may be accomplished with the provision of sensors which sense the level of the liquid in at least one of the hydro-pneumatic chambers to provide indications thereof to a valve control means for operation of the valving means in the first or second mode.

In order to ensure that the valving means is not exposed to the noise of the hydraulic pump during switching, liquid supplied by the pump may be shunted around the pump for a short time period in which the valving means switches between modes of operation.

DESCRIPTION OF THE PREFERRED EMBODIMENTS

Figure 1A:
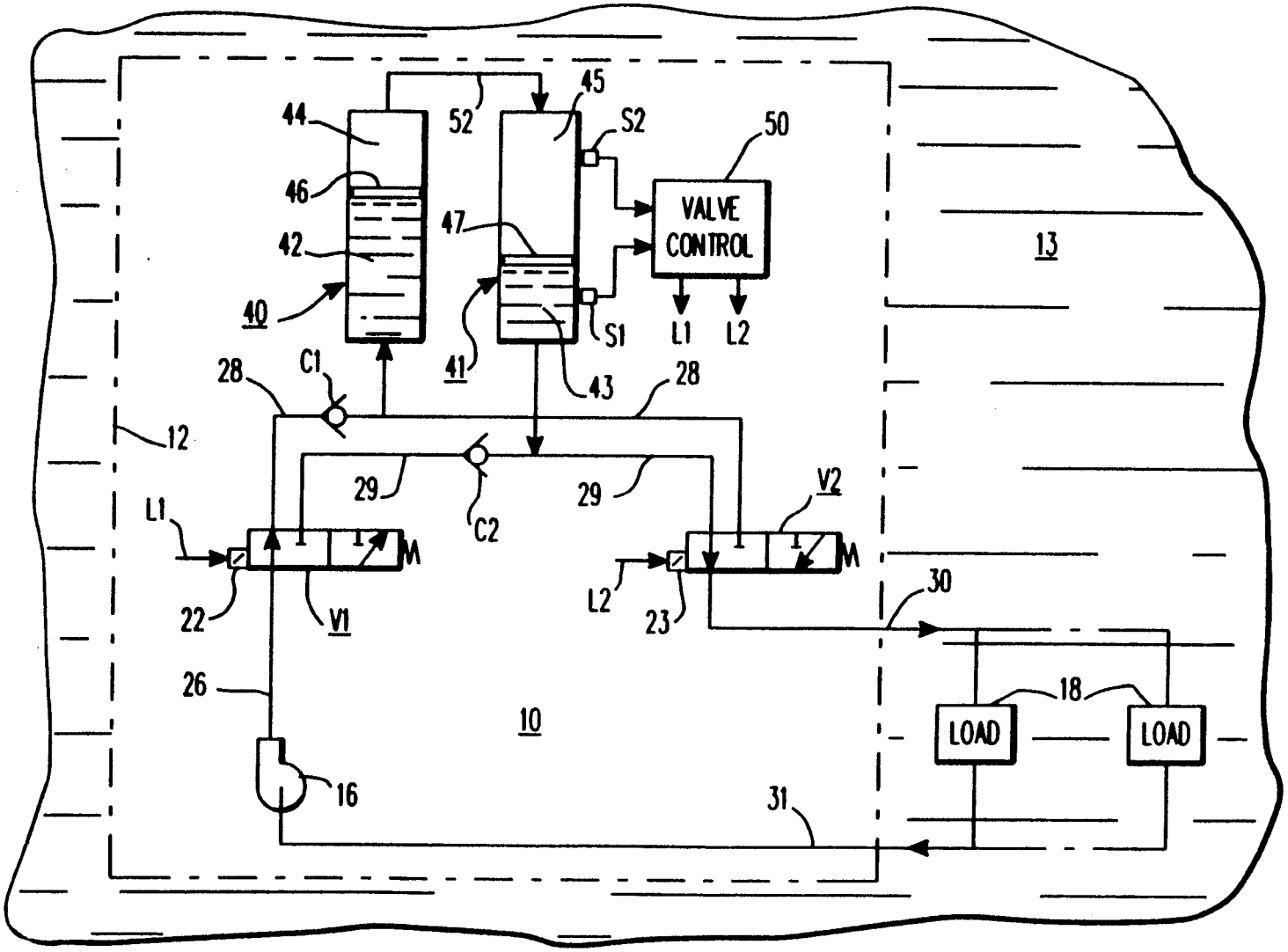
FIGS. 1A-1D illustrate the operation of one embodiment of the present invention.

In FIG. 1A, there is illustrated an underwater hydraulic system 10 disposed within a pressure vessel 12 located in a water medium 13. The pressure vessel 12 by way of example may be an underwater structure or submersible vehicle having a gas interior.

The hydraulic system 10 includes hydraulic pump means such as variable or fixed displacement pump 16 operable to supply hydraulic liquid to one or more hydraulic loads 18 situated outside of pressure vessel 12. For ease of presentation, conventional elements such as particle filters, reservoirs and relief valves, well known to those skilled in the art, have not been illustrated.

Disposed within the hydraulic circuit is a valving means which includes valves V1 and V2 illustrated as two position, three-way directional control valves, with each block within the symbolic representation of the valve corresponding to a spool or poppet position. Although the valves may be hydraulically operated, they are illustrated by way of example as being controlled by respective solenoids 22 and 23 which receive operating signals on respective lines L1 and L2.

The pump output line 26 is provided to the input of valve V1, the output of which is connected to first and second output lines 28 and 29 having respective check valves C1 and C2. Output lines 28 and 29 form two inputs to valve V2 having an output line 30 constituting a supply line for the loads, with the hydraulic liquid being returned to the input of pump 16 by means of return line 31.

To reduce liquidborne noise, the system includes first and second hydro-pneumatic chambers 40 and 41 each having a respective liquid side 42, 43 and a gas side 44, 45 separated by respective movable barriers in the form of pistons 46 and 47, although other barriers such as bladders or flexible separators may be used.

Associated with one of the hydro-pneumatic chambers, 41, is a sensing arrangement including sensors S1 and S2 operable to sense an upper and lower level of liquid in the hydro-pneumatic chambers 41 and to provide an indication thereof to a valve control circuit 50 which will provide output signals on lines L1 and L2 to solenoids 22 and 23 to control operation of valves V1 and V2.

The hydro-pneumatic chambers 40 and 41 are respectively connected to output lines 28 and 29 downstream of check valves Cl and C2. During operation, as illustrated in FIG. 1A, hydraulic liquid is provided by pump 16 via line 26 to the input of valve V1. In a first mode of operation in the position illustrated, this hydraulic liquid is blocked at valve V2 and accordingly liquid side 42 of hydro-pneumatic chamber 40 fills with hydraulic liquid causing the piston 46 to move in the direction of the arrow forcing a transfer of the gas from gas side 44 of hydro-pneumatic chamber 40 to gas side 45 of hydro-pneumatic chamber 41 by means of gas line 52.

This increase in gas pressure in hydro-pneumatic chamber 41 forces the fluid out of hydro-pneumatic chamber 41 and through the valve V2 to be supplied to a load device 18. This arrangement is effective at minimizing the transmission of liquidborne noise because of the large impedance mismatch between the liquid and the gas in the hydro-pneumatic chamber 40 and between the gas and the liquid in hydro-pneumatic chamber 41. Under all operating conditions, there is always gas in the liquid path from the pump to the load so as to continuously present the large impedance mismatch. This differs from the usual hydro-pneumatic chamber use in such systems wherein the hydro-pneumatic chamber is generally on a "T" connection of the pressure line which, although the hydraulic liquid pressure is stabilized, still presents a direct liquid path from the pump to the load.

Figure 1B:
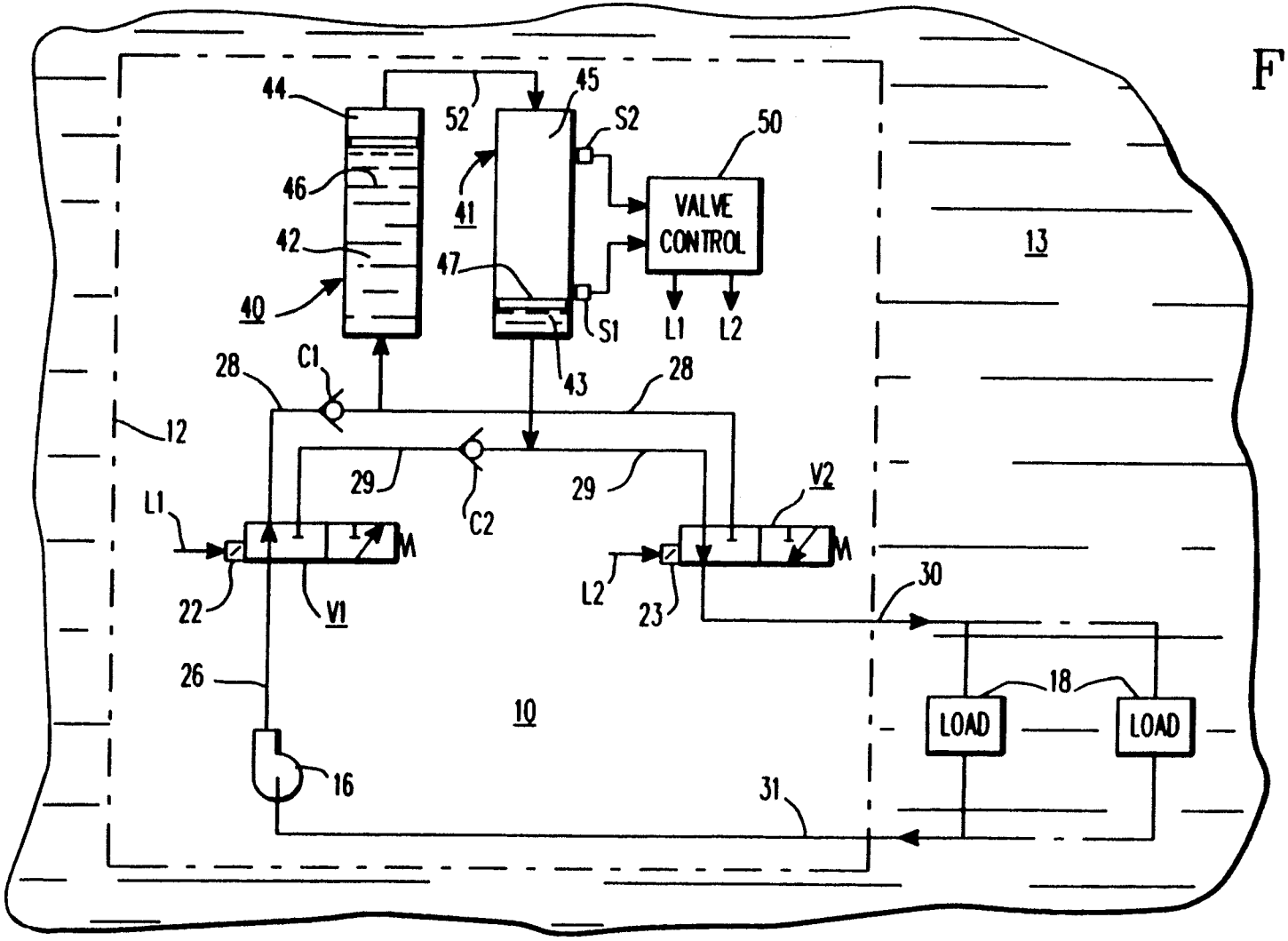
Figure 1C:
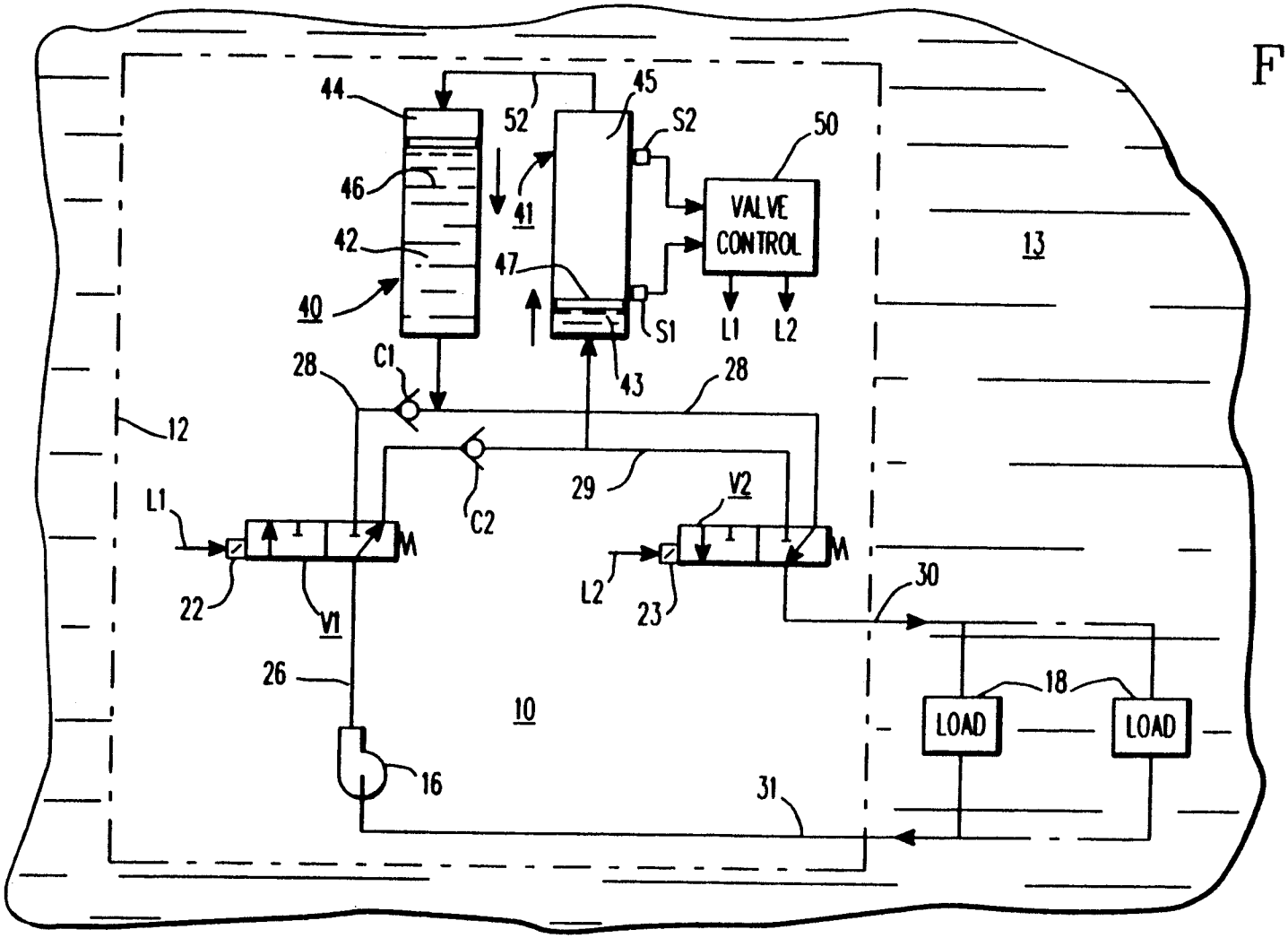

In FIG. 1B, piston 47 of hydro-pneumatic chamber 41 has attained a minimum predetermined position as sensed by sensor S1 thereby activating valve control circuit 50 to provide appropriate signals on lines L1 and L2 (a signal may be constituted by the presence or absence of solenoid power) to switch valves V1 and V2 to a second mode of operation as illustrated in FIG. 1C.

With the valves in the position as illustrated in FIG. 1C, hydraulic liquid supplied by pump 16 is now provided to hydro-pneumatic chamber 41 resulting in a gas transfer between the hydro-pneumatic chambers thus forcing liquid out of hydro-pneumatic chamber 40, through valve V2 to one or more of the loads 18.

Figure 1D:
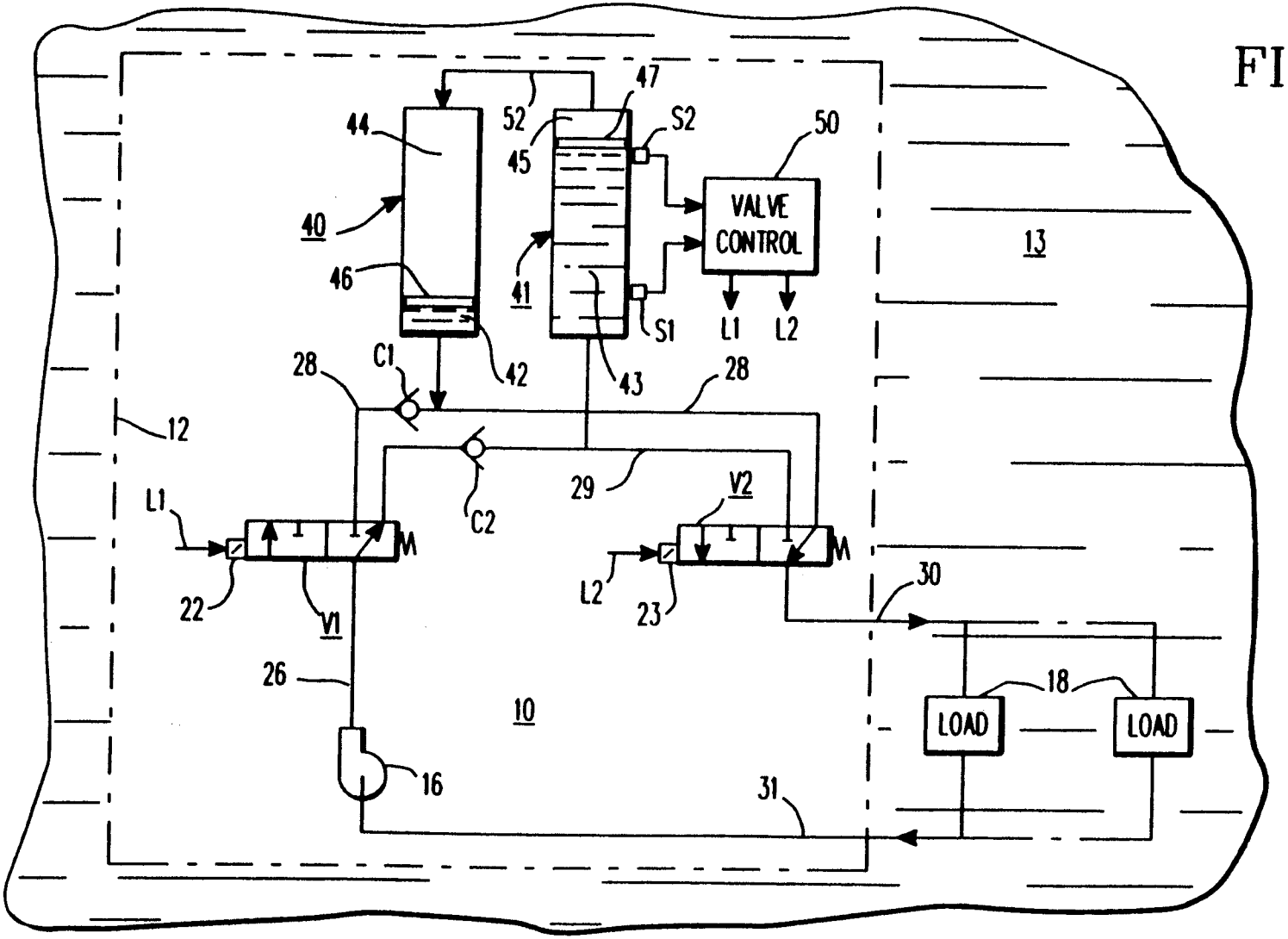

When piston 47 of hydro-pneumatic chamber 41 reaches its upper predetermined limit, as illustrated in FIG. 1D, sensor S1 provides an indication thereof to valve control circuit 50 which will then switch the valves V1 and V2 to the positions previously illustrated in FIG. 1A whereby the supply process is continued with one hydro-pneumatic chamber being filled by the pump while the other hydro-pneumatic chamber supplies the load, with a reversal of the roles occurring as one hydro-pneumatic chamber approaches its fill position and the other its empty position.

Figure 2A:
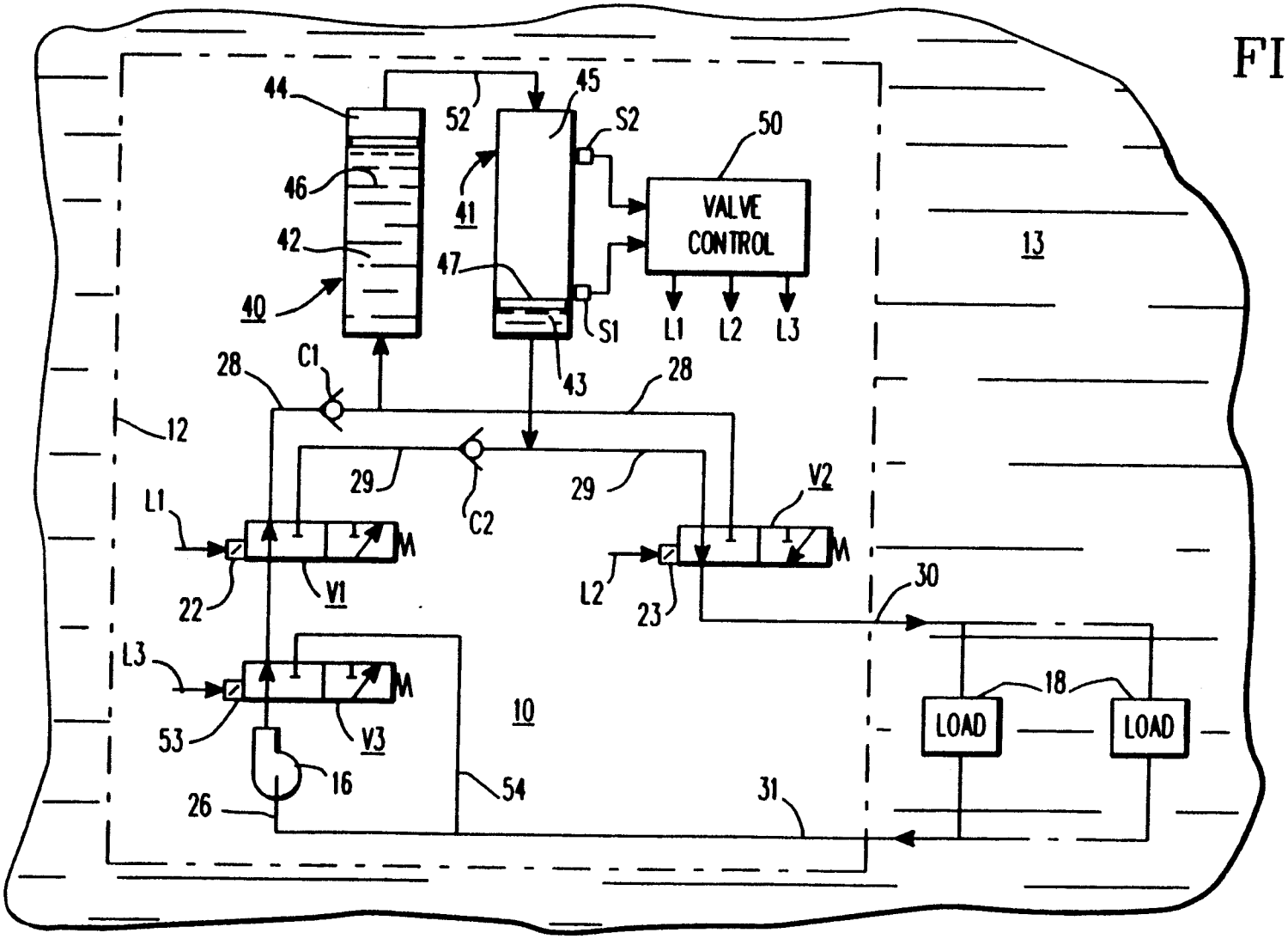
FIGS. 2A and 2B illustrate operation of an alternate embodiment of the present invention.
Figure 2B:
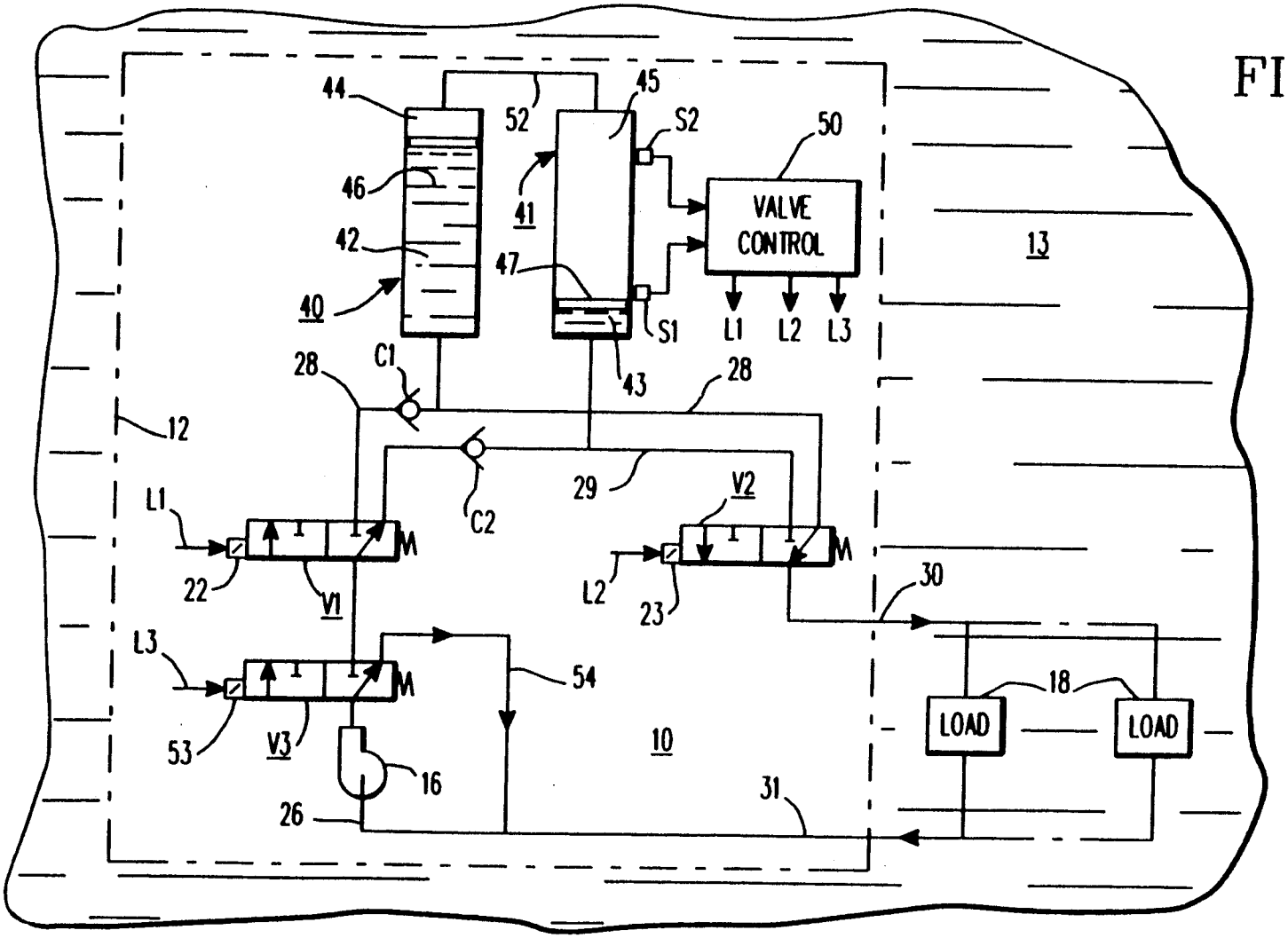

Liquidborne noise can potentially be further reduced during the switchover process of valves V1 and V2 with the provision of additional valving means in the form of two position, three-way valve V3 which is operated by solenoid 53 receiving an input signal on line L3 from valve control circuit 50. The shunting of hydraulic liquid during the switchover process is accomplished with the provision of shunt line 54 which, when valve V3 switched to its other position, illustrated in FIG. 2B, will divert the liquid flow while valves V1 and V2 switch from their positions illustrated in FIG. 2A to their positions illustrated in FIG. 2B, after which valve V3 will switch to its position indicated in FIG. 2A, all of such switching occurring in a time period measurable in fractions of a second.

Figure 3A:
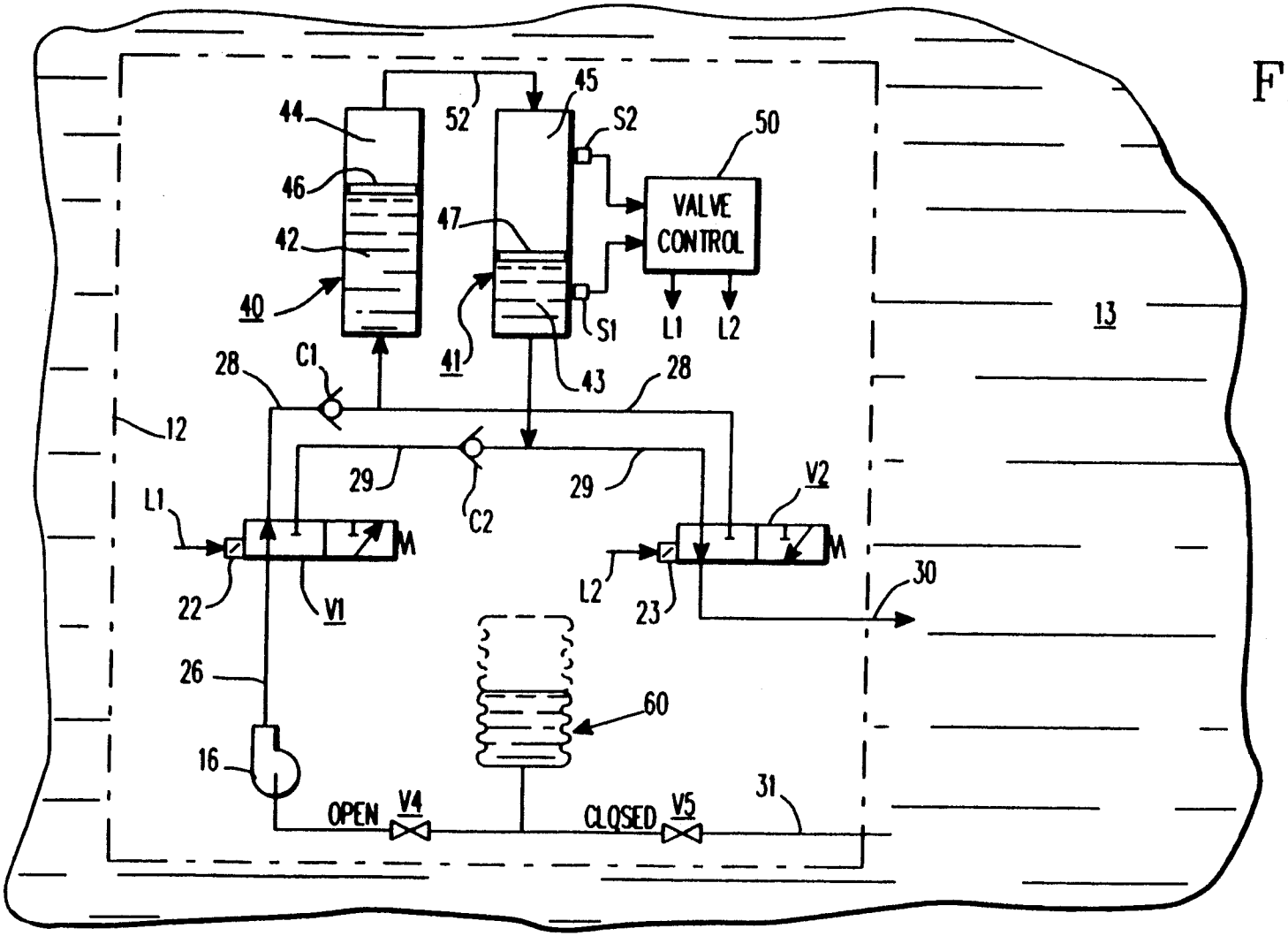
FIGS. 3A-3C illustrate an alternative embodiment of the invention.
Figure 3B:
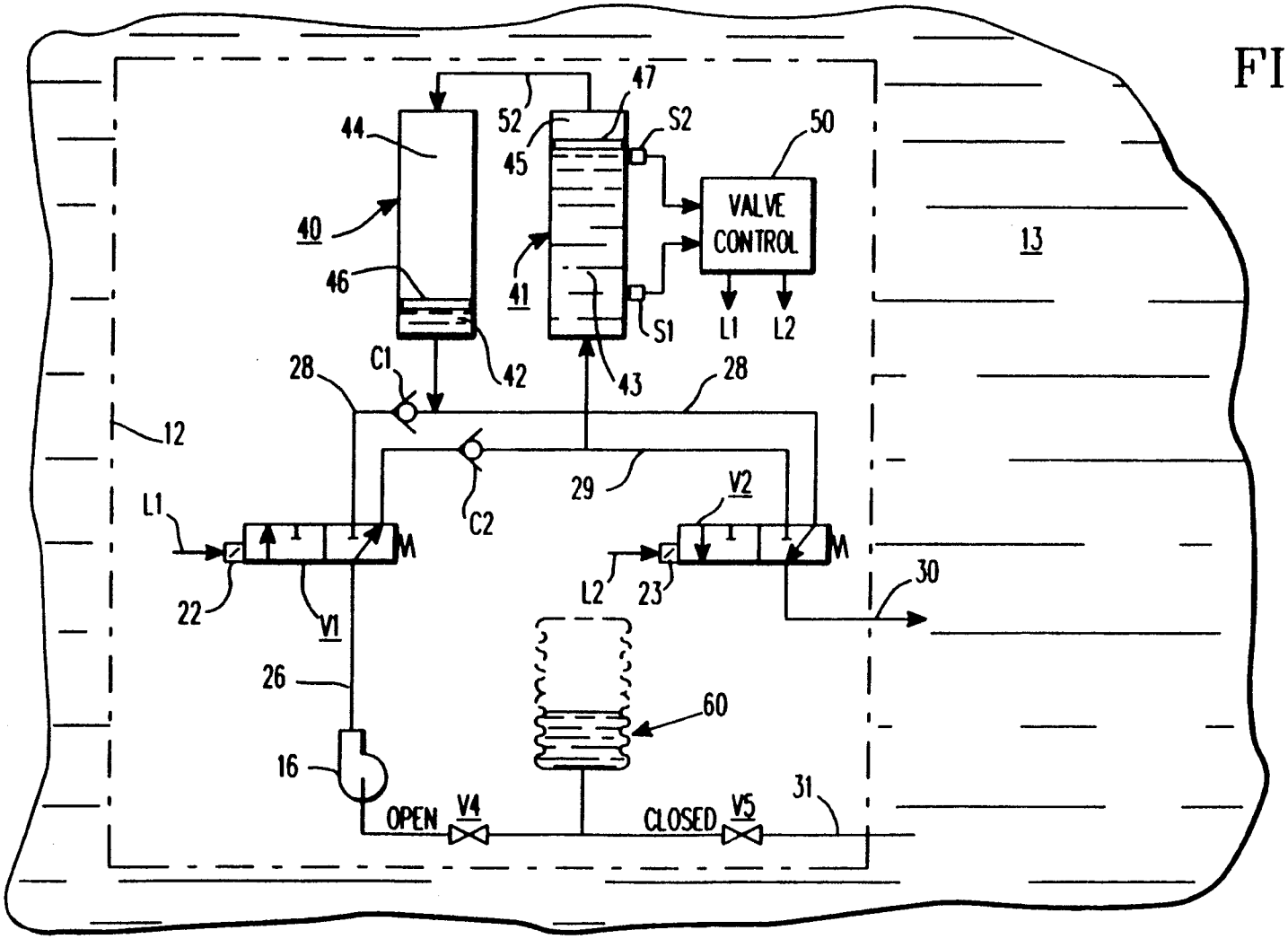
Figure 3C:
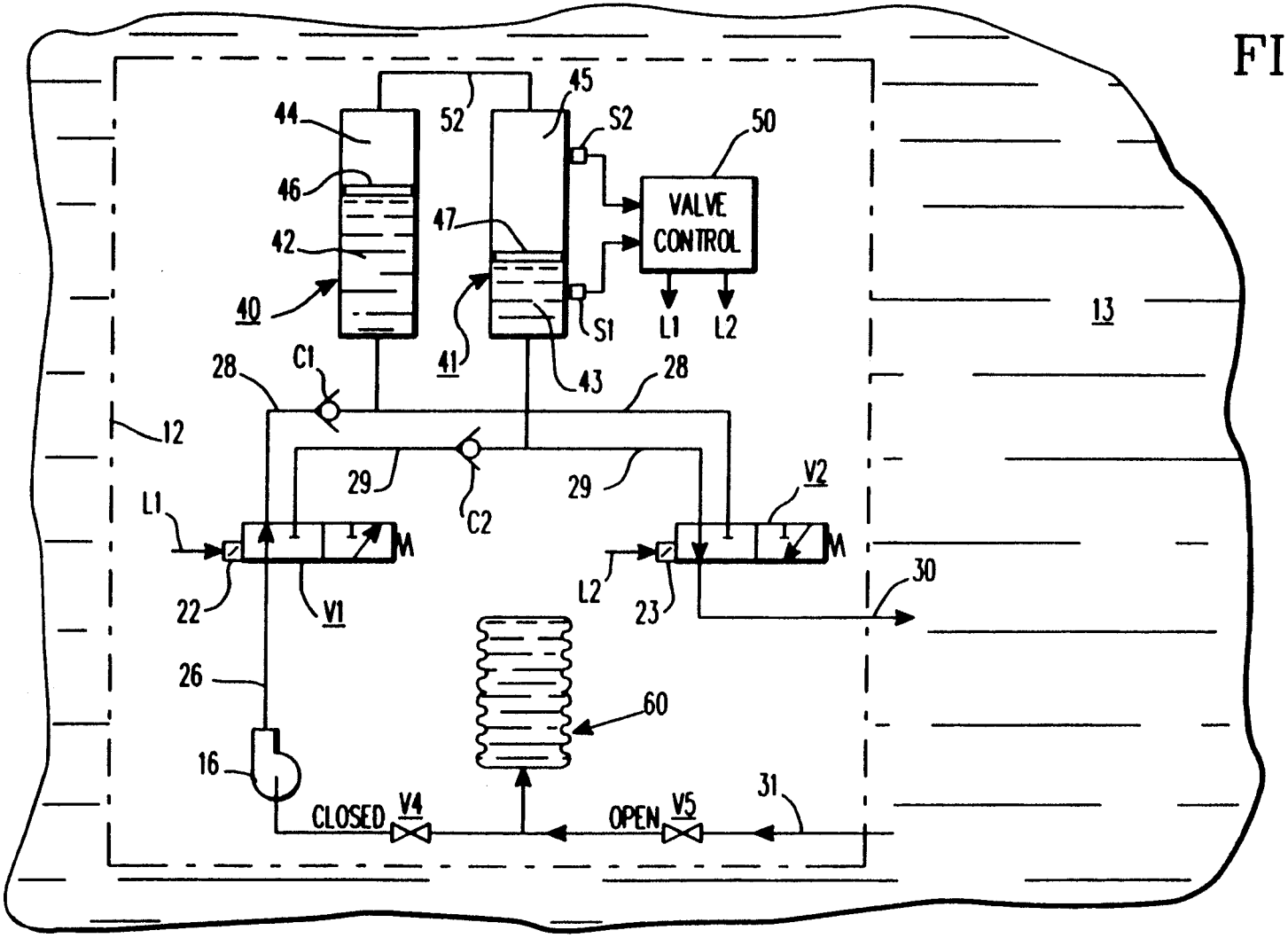

FIGS. 3A–3C illustrate another embodiment of the present invention. Various components previously described may be used in this embodiment and accordingly have been given the same reference characters.

The pressure vessel 12 represents a submersible vehicle, the buoyancy of which may be controlled by means of a ballast tank 60 which may be filled and emptied to adjust the ballast condition of the pressure vessel 12 when in the water environment.

Tank 60, also known as a soft tank, is provided with sea water to increase the weight of the pressure vessel; to decrease the weight, the sea water is pumped out of the tank. In FIG. 3A, the liquid line from tank 60 to the input of pump 16 includes a valve V4 which is in an open condition. Valve V5 in the return line 31 remains closed. In a manner similar to that previously described, valves V1 and V2 assume the position illustrated so that the seawater from tank 60 is pumped into hydro-pneumatic chamber 40 thereby displacing the gas in hydro-pneumatic chamber 40 in order to force the liquid out of hydro-pneumatic chamber 41 and through valve V2 into the ambient water medium via fluid line 30.

When the predetermined liquid level has been sensed by sensor S1, valve control circuit 50 is operable to activate valves V1 and V2 to the position illustrated in FIG. 3B whereby the roles of hydro-pneumatic chambers 40 and 41 are reversed, as previously described. The reversal process is continued until a desired amount of liquid has been pumped from the tank 60, constituting a first location, to the ambient water medium, constituting a second location.

Filling of the tank 60 to increase weight may be accomplished in a number of ways, one of which is illustrated in FIG. 3C. For filling the tank 60, valve V4 is closed while valve V5 is opened thereby allowing the external pressure of the ambient water to cause filling of tank 60 to a desired volume, after which valve V5 may be closed. Valves V4 and V5 may be manually, electrically or hydraulically operated.

Accordingly, there has been described a hydraulic system which functions to pump liquid from one location to another location with a significant reduction in liquid-borne noise by inserting a gas barrier in the fluid path. Such arrangement may be used with hydraulic liquid to activate load devices or for seawater ballast systems for underwater submersibles, by way of example.

I claim:

1. An underwater hydraulic system for reducing liquidborne noise, comprising:

a) hydraulic pump means for delivering liquid from a first location to a second location;

b) means including a gas barrier positioned between said pump means and said second location such that there is no direct liquid connection between said pump means and said second location;

c) said pump means being in the liquid path between said first and second locations.

2. An underwater hydraulic system for reducing liquidborne noise, comprising:

a) hydraulic pump means for delivering liquid from one location to another;

b) first and second hydro-pneumatic chambers, each having a liquid side and a gas side separated by a moveable barrier;

c) means connecting the gas sides of said hydro-pneumatic chambers to one another;

d) valving means operable, in a first mode of operation, to communicate the liquid provided by said pump means from said one location to the liquid side of said first hydro-pneumatic chamber and to provide the liquid in the liquid side of said second hydro-pneumatic chamber to said other location as said gas is transferred from said first to said second hydro-pneumatic chamber;

e) said valving means being operable, in a second mode of operation to communicate the provided by said pump means from said one location to the liquid side of said second hydro-pneumatic chamber and to provide the liquid in the liquid side of said first hydro-pneumatic chamber to said other location as said gas is transferred from said second to said first hydro-pneumatic chamber.

3. A system according to claim 2 wherein:

a) said pump means and said valving means are located in an underwater pressure vessel; and b) said liquid is the surrounding water medium.

4. A system according to claim 2 wherein:

a) said pump means and said valving means are located in an underwater pressure vessel; and which includes b) a ballast tank which may be filled and emptied to adjust the ballast condition of said pressure vessel when in the water environment;

c) means for filling said tank with water from the ambient water medium;

d) means connecting said tank with said pump means;

e) said tank constituting said one location;

f) said ambient water medium constituting said other location.

5. A system according to claim 4 wherein:

a) said means for filling includes i) a liquid line connecting said tank with said ambient medium, and ii) a valve in said liquid line; and b) said means connecting said tank with said pump means includes i) a liquid line, and ii) a valve in the latter said liquid line.

6. An underwater hydraulic system for reducing liquidborne noise, comprising:

a) hydraulic pump means for delivering hydraulic liquid to at least one hydraulic load;

b) first and second hydro-pneumatic chambers, each having a liquid side and a gas side separated by a moveable barrier;

c) means connecting the gas sides of said hydro-pneumatic chambers to one another;

d) valving means operable, in a first mode of operation, to communicate the liquid provided by said pump means to the liquid side of said first hydro-pneumatic chamber and to provide the liquid in the liquid side of said second hydro-pneumatic chamber to said load as said gas is transferred from said first to said second hydro-pneumatic chamber;

e) said valving means being operable, in a second mode of operation to communicate the liquid provided by said pump means to the liquid side of said second hydro-pneumatic chamber and to provide the liquid in the liquid side of said first hydro-pneumatic chamber to said load as said gas is transferred from said second to said first hydro-pneumatic chamber.

7. A system according to claim 6 wherein:

a) said valving means is operable, in a third mode of operation, to shunt the liquid supplied by said pump when said valving means switches from said first mode of operation to said second mode of operation and vice versa.

8. A system according to claim 6 which includes:

a) control means operable to sense the level of liquid in at least one of said hydro-pneumatic chambers and operable to selectively place said valving means into said modes of operation.

9. An underwater hydraulic system for reducing liquidborne noise, comprising:

a) hydraulic pump means for delivering hydraulic liquid to at least one hydraulic load and including a pump output line and a pump return line;

b) first and second hydro-pneumatic chambers, each having a liquid side and a gas side separated by a moveable barrier;

c) a gas line connecting the gas sides of said hydro-pneumatic chambers to one another;

d) a first valve having first and second output lines and an input connected to said pump output line;

e) first and second check valves respectively connected in said first and second output lines;

f) said first and second hydro-pneumatic chambers being respectively connected to said first and second output lines downstream of said check valves;

g) a second valve having an output supply line connected to said load and first and second inputs respectively connected to said first and second output lines;

h) means for sensing the liquid level in at least one of said hydro-pneumatic chambers to provide an indication thereof;

i) control means responsive to an indication of a first liquid level to place said valves into a first mode of operation to communicate the liquid provided by said pump means to the liquid side of said first hydro-pneumatic chamber via said first output line and to provide the liquid in the liquid side of said second hydro-pneumatic chamber to said second valve via said second output line as said gas is transferred from said first to said second hydro-pneumatic chamber whereby liquid is supplied to said load via said supply line;

j) said control means being additionally operable in response to an indication of a second liquid level to place said valves into a second mode of operation to communicate the liquid provided by said pump means to the liquid side of said second hydro-pneumatic chamber via said second output line and to provide the liquid in the liquid side of said first hydro-pneumatic chamber to said second valve via said first output line as said gas is transferred from said second to said first hydro-pneumatic chamber whereby liquid is supplied to said load via said supply line.

10. A system according to claim 9 wherein:

a) said first and second valves are two position-three way valves.

11. A system according to claim 9 wherein:

a) at least one of said hydro-pneumatic chamber includes a piston member as its moveable barrier;

b) said means for sensing includes first and second sensors positioned to respectively sense an upper limit of travel and a lower limit of travel of said piston member.

12. A system according to claim 9 which includes:

a) a third, two position-three way valve having an input connected to said pump output line, a first output connected to the input of said first valve and a second output connected to a shunt line;

b) said shunt line being connected to said pump return line.

13. A system according to claim 12 wherein:

a) said control means is operable to control the positioning of said third valve.

* * * * *